US007565754B1

(12) United States Patent
Acheson et al.

(10) Patent No.: US 7,565,754 B1
(45) Date of Patent: Jul. 28, 2009

(54) ARTICLE OF FOOTWEAR HAVING A CUSHIONING SOLE

(75) Inventors: Jeff Acheson, Brookline, MA (US); David J. Lacorazza, Norwell, MA (US)

(73) Assignee: Reebok International Ltd., Canton, MA (US)

( * ) Notice: Subject to any disclaimer, the term of this patent is extended or adjusted under 35 U.S.C. 154(b) by 377 days.

(21) Appl. No.: 11/399,359

(22) Filed: Apr. 7, 2006

(51) Int. Cl.
*A43B 13/12* (2006.01)

(52) U.S. Cl. ..... 36/28; 36/144

(58) Field of Classification Search ..... 36/25 R, 36/28, 29, 31, 30 R, 114
See application file for complete search history.

(56) References Cited

U.S. PATENT DOCUMENTS

| | | | |
|---|---|---|---|
| 545,705 | A | 9/1895 | MacDonald |
| 625,393 | A | 5/1899 | Hafertepen |
| 900,867 | A | 10/1908 | Miller |
| 1,498,838 | A | 6/1924 | Harrison, Jr. |
| 2,100,492 | A | 11/1937 | Sindler |
| 2,288,168 | A | 6/1942 | Leu |
| 2,751,692 | A | 6/1956 | Cortina |
| 2,983,056 | A | 5/1961 | Murawski |
| 3,719,965 | A | 3/1973 | Chevallereau |
| 3,785,646 | A | 1/1974 | Ruskin |
| 3,816,945 | A | 6/1974 | Egtvedt |
| 3,824,716 | A | 7/1974 | Di Paolo |
| 3,834,046 | A | 9/1974 | Fowler |
| 4,183,156 | A | 1/1980 | Rudy |
| 4,219,945 | A | 9/1980 | Rudy |
| 4,227,320 | A | 10/1980 | Borgeas |
| 4,262,433 | A | 4/1981 | Hagg et al. |

(Continued)

FOREIGN PATENT DOCUMENTS

| | | |
|---|---|---|
| CA | 1176458 | 10/1984 |

(Continued)

OTHER PUBLICATIONS

Reebok Third Quarter 2005 Footwear Catalog, p. 5, showing the Vector 8000 shoe, p. 8, showing the Premier FSM DMX II shoe, p. 11, showing the Vector Total Shear and Vector Shear Strip EX II shoes, p. 12, showing the Vector Molten Fire and Vector Liquid Fire shoes, p. 26, showing the Speed Trainer Shear EX and RXT DMX Shear Shoes, p. 32, showing the Classic Leather Tech shoe, and p. 88 showing the Sammer and Sammer Zip shoes.

(Continued)

*Primary Examiner*—Marie Patterson
(74) *Attorney, Agent, or Firm*—Sterne, Kessler, Goldstein & Fox P.L.L.C.

(57) ABSTRACT

The present invention is generally directed to a sole for an article of footwear. The sole generally defining a heel region, a forefoot region and an arch region that is disposed between the heel region and the forefoot region. The sole has a foot support extending from the heel region to the forefoot region, with a shank plate coupled to a lower surface of the foot support. The sole further includes a lateral heel piece and a medial heel piece, such that at least one of the medial or lateral heel pieces includes a plurality of tubes. A heel outsole is coupled to at least one of said medial or lateral heel pieces.

27 Claims, 9 Drawing Sheets

U.S. PATENT DOCUMENTS

| | | | | |
|---|---|---|---|---|
| 4,271,606 | A | 6/1981 | Rudy | |
| 4,307,521 | A | 12/1981 | Inohara et al. | |
| 4,319,412 | A | 3/1982 | Muller et al. | |
| 4,359,830 | A | 11/1982 | Inohara | |
| 4,364,189 | A | 12/1982 | Bates | |
| 4,430,810 | A | 2/1984 | Bente | |
| 4,445,284 | A | 5/1984 | Sakutori | |
| 4,451,994 | A | 6/1984 | Fowler | |
| 4,452,598 | A | 6/1984 | Marsh | |
| 4,457,084 | A | 7/1984 | Horibata et al. | |
| 4,507,879 | A | 4/1985 | Dassler | |
| 4,535,553 | A | 8/1985 | Derderian et al. | |
| 4,546,556 | A | 10/1985 | Stubblefield | |
| 4,547,979 | A | 10/1985 | Harada et al. | |
| 4,573,279 | A | 3/1986 | Feurer-Zogel et al. | |
| 4,593,482 | A | 6/1986 | Mayer | |
| 4,624,061 | A | 11/1986 | Wezel et al. | |
| 4,656,760 | A | 4/1987 | Tonkel et al. | |
| 4,680,875 | A | 7/1987 | Danieli | |
| 4,754,559 | A | 7/1988 | Cohen | |
| 4,782,603 | A | 11/1988 | Brown | |
| 4,798,010 | A | 1/1989 | Sugiyama | |
| D299,681 | S | 2/1989 | Miller et al. | |
| 4,864,737 | A | 9/1989 | Marrello | |
| 4,890,397 | A | 1/1990 | Harada et al. | |
| 4,914,836 | A | 4/1990 | Horovitz | |
| 4,922,631 | A | 5/1990 | Anderie | |
| 4,924,605 | A | 5/1990 | Spademan | |
| 5,005,300 | A | 4/1991 | Diaz et al. | |
| 5,012,597 | A | 5/1991 | Thomasson | |
| D336,771 | S | 6/1993 | Hatfield et al. | |
| 5,220,737 | A | 6/1993 | Edington | |
| 5,224,810 | A | 7/1993 | Pitkin | |
| 5,313,718 | A | 5/1994 | McMahon et al. | |
| 5,373,649 | A | 12/1994 | Choi | |
| 5,456,027 | A | 10/1995 | Tecchio et al. | |
| 5,461,800 | A * | 10/1995 | Luthi et al. | 36/28 |
| 5,481,814 | A | 1/1996 | Spencer | |
| D366,756 | S | 2/1996 | Forland et al. | |
| 5,595,002 | A | 1/1997 | Slepian et al. | |
| 5,595,003 | A | 1/1997 | Snow | |
| D378,012 | S | 2/1997 | Le | |
| 5,625,963 | A | 5/1997 | Miller | |
| D386,589 | S | 11/1997 | Cass | |
| D386,590 | S | 11/1997 | Cass | |
| 5,685,092 | A | 11/1997 | Prieskorn | |
| D393,339 | S | 4/1998 | Fogg | |
| 5,784,808 | A | 7/1998 | Hockerson | |
| D397,845 | S | 9/1998 | Cass | |
| D397,848 | S | 9/1998 | Avar | |
| 5,822,886 | A * | 10/1998 | Luthi et al. | 36/28 |
| D411,579 | S | 6/1999 | Dolinsky | |
| 5,993,585 | A | 11/1999 | Goodwin et al. | |
| 5,996,253 | A | 12/1999 | Spector | |
| 6,115,943 | A | 9/2000 | Gyr | |
| 6,119,371 | A | 9/2000 | Goodwin et al. | |
| 6,311,414 | B1 * | 11/2001 | Kita | 396/28 |
| D467,725 | S | 12/2002 | McDowell | |
| D472,043 | S | 3/2003 | Kuerbis | |
| D485,672 | S | 1/2004 | Holmes | |
| D485,673 | S | 1/2004 | Smith | |
| D499,247 | S | 12/2004 | Wahoske | |
| D499,541 | S | 12/2004 | Dolan | |
| D499,878 | S | 12/2004 | Rask | |
| D500,585 | S | 1/2005 | Wahoske | |
| 6,898,870 | B1 * | 5/2005 | Rohde | 36/28 |
| 6,983,555 | B2 | 1/2006 | Lacorazza et al. | |
| 7,013,582 | B2 * | 3/2006 | Lucas et al. | 36/28 |
| 2004/0049946 | A1 * | 3/2004 | Lucas et al. | 36/28 |
| 2004/0154189 | A1 * | 8/2004 | Wang | 36/28 |
| 2006/0032087 | A1 | 2/2006 | Lacorazza et al. | |
| 2006/0277791 | A1 * | 12/2006 | Schoenborn et al. | 36/28 |
| 2006/0277792 | A1 * | 12/2006 | Schoenborn | 36/28 |
| 2007/0033830 | A1 * | 2/2007 | Chang | 36/28 |
| 2007/0113425 | A1 * | 5/2007 | Wakley et al. | 36/28 |
| 2007/0193065 | A1 * | 8/2007 | Nishiwaki et al. | 36/27 |

FOREIGN PATENT DOCUMENTS

| | | |
|---|---|---|
| CH | 483 807 | 2/1970 |
| EP | 0 192 820 | 9/1986 |
| WO | WO 91/15973 | 10/1991 |

OTHER PUBLICATIONS

Reebok Second Quarter 2005 Footwear Catalog, p. 6, showing the Premier Ultra DMX II and Premier Control DMX II shoes, p. 8, showing the Premier Road Plus II and Premier Trail DMX II shoes, p. 9, showing the Vector Shear Strip EX, Vector Flash Leather, and Vector Flash shoes, p. 12, showing the Turbocharge Shear EX and Prodigy DMX Shear shoes, and p. 13, showing the Agility CXT shoes.

Reebok Fall 2004 Footwear Catalog, p. 9, showing the Prodigy Trainer DMX shoe.

Reebok Second Quarter 1999 Footwear Catalog, p. 42, showing The Question Low shoe.

Reebok Fourth Quarter 2000 Footwear Catalog, p. 18, showing The Question Mid shoe.

Reebok 1990 Footwear Catalog, showing the ERS™ 2000 shoe.

Reebok Second Quarter 1998 Footwear Catalog, p. 14, showing the Eolian DMX™ $_6$ Low shoe.

Reebok Spring 2004 Footwear Catalog, p. 4, showing the Premier Ultra DMX, Premier FSM DMX, and Premier Control DMX shoes, p. 10, showing the Venta Trainer DMX shoe, and p. 67, showing the Diversion Zip, Ellery-girls and Ellery Zip-girls shoes.

Reebok Third Quarter 2003 Footwear Catalog, p. 4, showing the Premier FSM and Premier Road Lite shoes, and p. 61, showing the Streetwinder II Zip shoe.

Reebok Spring 2002 Footwear Catalog, p. 13, showing the Instructor III DMX and Power Trainer III DMX shoes, p. 16, showing the U-Shuffle DMX, and p. 56, showing the Medallion DMX and Allure DMX shoes.

Reebok Fourth Quarter 2003 Footwear Catalog, p. 4, showing the Premier Road Lite DMX shoe, p. 5, showing the Premier Walk AW DMX shoe, p. 52, showing the Streetwinder II Zip, and p. 60, showing the Classic Leather Streak II Mid shoe.

Reebok Second Quarter 2002 Footwear Catalog, p. 46, showing the Rapid Fire shoe.

Reebok Second Quarter 2001 Footwear Catalog, p. 18, showing the DMXplorer Low II shoe and p. 52, showing the Miramar II DMX shoe.

Reebok Spring 1999 Footwear Catalog, p. 16, showing the Duration Trainer shoe.

Reebok Spring 1998 Footwear Catalog, p. 22, showing the VersaMax Hex, Tempo Mid and Ascender shoes, p. 46, showing The Answer and Shaq™ Reflection shoes, p. 60, showing the Bandit shoe, and p. 65, showing the Net Master and Court Performer Mid shoes.

Reebok Second Quarter 1997 Footwear Catalog, p. 11, showing the Electron shoe, p. 12, showing the Statement Mid and Scorch Low shoes, and p. 16, showing the Rain Man shoe.

Reebok Fall 1997 Footwear Catalog, p. 22, showing the Resolution shoe, p. 24, showing the DMX RXT shoe, p. 25, showing the Hexample Low shoe, p. 38, showing the Grooveline shoe, p. 42, showing the Court Legacy and Net Guru shoes, and p. 48, showing the Mud Dogger shoe.

Reebok Fall 1999 Footwear Catalog, p. 27, showing the Armadillo shoe.

Reebok Spring 1994 Footwear Catalog, p. 15, showing The Pump™ Fury, and p. 19, showing the Graphlite Road shoe.

Reebok Fall 1995 Footwear Catalog, p. 63, showing the Instapump™ Fury shoe.

Reebok Fall 1998 Footwear Catalog, p. 18, showing the Maverick shoe, p. 20, showing theVersa Run Ultra shoe, p. 21, showing the Psych shoe, and p. 38, showing the Run DMX® $_6$ shoe.

Reebok Spring 1996 Footwear Catalog, p. 16, showing the Rail shoe, p. 39, showing the Sunami Mid, and p. 61, showing the Fury Road and Avenger shoes.
Reebok Fourth Quarter 1997 Footwear Catalog, p. 8, showing the Tempo Mid shoe, p. 10, showing the Impact Mid shoe, p. 12, showing the Rush II, p. 18, showing the School-U and Reignman II shoes, p. 19, showing the Thunder and The S.T.T. shoes, and p. 20, showing the Racketeer shoe.

* cited by examiner

ARTICLE OF FOOTWEAR HAVING A CUSHIONING SOLE

FIELD OF THE INVENTION

The present invention relates generally to an article of footwear and a cushioning sole therein.

BACKGROUND OF THE INVENTION

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the Achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. The discomfort for the wearer that results may diminish the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole (typically, an outsole, midsole and insole) which absorbs shocks. However, the sole should also possess enough resiliency to prevent the sole from being "mushy" or "collapsing," thereby unduly draining the energy of the wearer. Rather, it is preferred that a sole rebound to return energy to the wearer.

In light of the above, numerous attempts have been made over the years to incorporate into a shoe a means for providing improved cushioning and resiliency to the shoe. For example, attempts have been made to enhance the natural elasticity and energy return of the foot by providing shoes with soles which store energy during compression and return energy during expansion. These attempts have included the formation of shoe soles that include springs, gels or foams such as ethylene vinyl acetate (EVA) or polyurethane (PU). However, all of these tend to either break down over time or do not provide adequate cushioning characteristics. Further, a large block of foam within a sole can cause excessive weight. Additional weight can drain energy with each step.

BRIEF SUMMARY OF THE INVENTION

The present invention is generally directed to a sole for an article of footwear. The sole generally defines a heel region, a forefoot region and an arch region disposed between the heel region and the forefoot region. The sole further includes a foot support extending from the heel region to the forefoot region, and a shank plate is coupled to a lower surface of the foot support. The sole further includes a lateral heel piece and a medial heel piece, such that at least one of the medial or lateral heel pieces includes a plurality of tubes. A heel outsole is coupled to at least one of said medial or lateral heel pieces.

This arrangement provides improved cushioning and support for an article of footwear, particularly during athletic activity. Medial and lateral heel pieces accommodate uneven compression forces and shear or sideways forces that may occur during a typical walking or running gait cycle.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
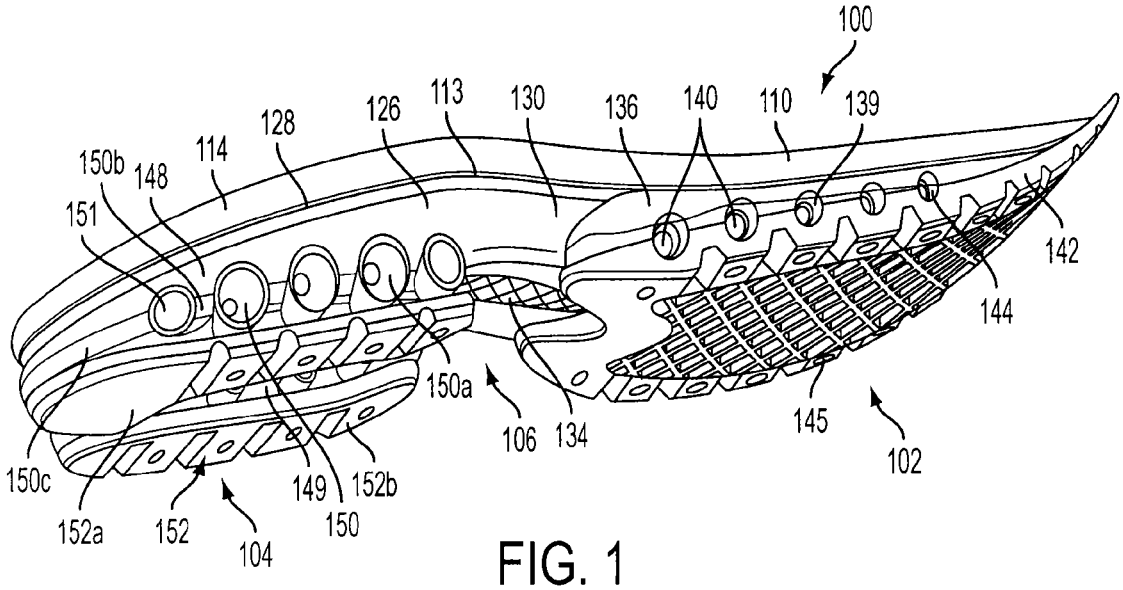
FIG. 1 is a perspective side view of an embodiment of a sole of an article of footwear of the present invention.

The present invention will be described with reference to the accompanying drawings. The drawing in which an element first appears is typically indicated by the leftmost digit(s) in the corresponding reference number.

Figure 2:
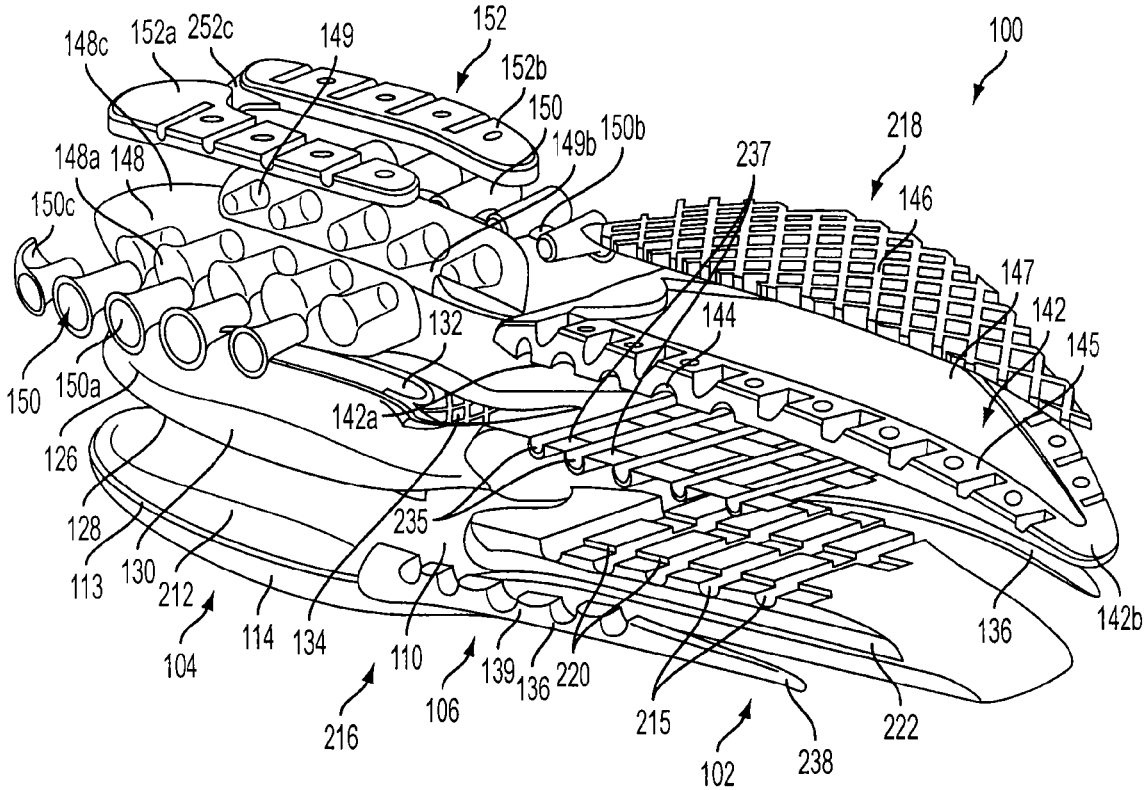
FIG. 2 is an exploded bottom perspective view of the sole of FIG. 1.

Illustrated in FIGS. 1 and 2 is a sole 100 of an article of footwear. FIG. 1 shows a lateral side of a right sole 100. One skilled in the art would appreciate that a lateral side of a left sole would be a mirror image of sole 100. Sole 100 is generally provided in an article of footwear, or shoe, that further includes an upper (see for example upper 303 in FIG. 3) that is attached to sole 100. An upper may be any natural or synthetic fabric or another material that would be apparent to one skilled in the art. The upper may be attached to sole 100 via conventional lasting techniques, by adhesives, molding, or by any other method that would be apparent to one skilled in the art.

Sole 100 generally defines a forefoot region 102, a heel region 104 and an arch region 106, which is between forefoot region 102 and heel region 104. Forefoot, heel and arch regions need not have defined boundaries.

Sole 100 includes a foot support 110. Foot support 110, as illustrated in FIGS. 1 and 2, extends from forefoot region 102 to heel region 104 so as to substantially extend the entire length of sole 100. Foot support 110 is molded, extruded or otherwise formed to be thin and lightweight. Foot support 110 may be made of a urethane foam, such as a polyurethane or an EVA (ethylene vinyl acetate), which is conventionally used for an entire midsole. For example, one type of foam is Injection molded EVA (IMEVA) with a 51C hardness. Foot support 110 provides a first cushioning layer to sole 100. Foot support 110 may provide sufficient comfort for the wearer, for example, when sitting or standing. However, foot support 110 may not, alone, provide sufficient cushioning or support during light to heavy athletic activity. Foot support 110 is positioned very close to a user's foot to provided comfort thereto. Preferably, foot support 110 is the softest foam used in sole 100.

Foot support 110 has an upper surface (not shown), a lower surface 212 and a side surface 114. Although sole 100 is turned upside down in FIG. 2, such that lower surface 212 is illustrated above the upper surface, continued reference to "upper surfaces" and "lower surfaces" are defined with respect to the shoe when positioned with a foot inserted in to the shoe and the individual is standing, notwithstanding the orientation of the sole in the figures.

The upper surface of foot support 110 may be attached to an upper, or an upper may extend below foot support 110 and may be attached to lower surface 212 of foot support 110.

Side surface 114 of foot support 110 may extend above the upper surface of the sole, such that the upper surface of the foot support 110 is generally concaved within the side surface 114 forming a cradle for the foot. Similarly, as illustrated in FIG. 2, lower surface 212 may be convexly curved, at least in heel region 104. Further, generally in a central portion of heel region 104, foot support 110 may have a protrusion (see for example protrusion 731 in FIGS. 7 and 8) extending from lower surface 212. A shoulder 113 may be molded into foot support 110 where side surface 114 meets lower surface 212.

In forefoot region 102 and perhaps extending into arch region 106 of sole 100, are provided a series of concaved channels 215 that extend from a lateral side 216 to a medial side 218 of sole 100. Further, between channels 215, foot support 110 may also feature shallow indentations 220 extending in a forefoot to heel direction. Further, a curved cut-out 222 is formed in foot support 110 at a lateral-most and medial-most side of the foot support 110 in the forefoot region 102.

Sole 100 further includes a shank plate 126. Shank plate 126 may be made from a hard moldable plastic. Preferably, shank plate 126 is an injection molded, non-foamed plastic component. For example, one material may be injection molded thermoplastic polyurethane (TPU) with a shore hardness of 64D, commercially as ELASTROGRAN GMBU available from BASF Corporation (Florham Park, N.J.). Shank plate 126 may be rigid and provides a backbone structure to the components of sole 100 and helps to distribute load evenly to sole 100. Shank plate 126 may have a concaved upper surface (not shown) which has a rim 128 that fits against shoulder 113 of foot support 110. Similar to foot support 110, shank plate 126 may have a generally convexed lower surface 130, particularly in heel region 104. Heel region 104 of shank plate 126 may also include a cut-out portion 132, through which foot support 110 is visible and which may receive a protrusion (such as protrusion 731) formed in lower surface 212 of foot support 110.

Shank plate 126 may also be molded into a lattice shape design 134 in an arch region 106 of sole 100. The lattice shape design 134 may be merely ornamental, but may provide some ventilation to the foot, for example, if the material used to form foot support 110 is sufficiently porous for air to pass therethrough or if foot support 110 includes further holes therein adjacent lattice shape design 134 of shank plate 126. Additionally, lattice shaped design 134 reduces the weight of shank plate 126 and may provide some flexibility to shank plate in arch region 106.

Shank plate 126 is further formed with a plurality of semi-circular ribs 235 aligned in a forefoot to heel direction and extending from near lateral side 216 to near medial side 218 of sole 100 in the forefoot region 102. Semi-circular ribs 235 may be spaced apart by struts 237. Semicircular ribs 235 are received in concaved channels 215 of foot support 110, while struts 237 are received in shallow indentations 220 of foot support 110. Ribs 235 are provided in forefoot region 102 to provide the structure of shank plate 126, with the necessary flexibility of forefoot region 102. Unlike heel region 104, forefoot region 102 flexes during a typical gait cycle. Since shank plate 126 is generally rigid in heel region 104 and does not flex, struts 237 of shank plate 126 will flex or bend in the forefoot region 102 causing semicircular ribs 235 to bend with respect to one another. Thus, shank plate 126 is flexible in the forefoot region 102, while still providing support thereto. Additionally, ribs 235 reinforce channels 215 formed in foot support 110.

As illustrated in FIG. 1, ribs 235 may be concealed from the exterior of sole 100 by medial and lateral covers 136. Medial and lateral covers 136 are coupled to and received in curved cut-outs 222 in foot support 110. Medial and lateral covers 136 have a lower surface 238 with a plurality of channels 139 formed therein to align with each of ribs 235 of shank plate 126 and/or concaved channels 215 of foot support 110. Thus, medial and lateral covers 136 define a portion of bores 140 that extend from lateral side 216 to medial side 218 of sole 100 in a forefoot region 102.

Medial and lateral covers 136 may be molded foam, such as polyurethane or EVA foams, and may be formed integrally with foot support 110 or as separately molded pieces. Alternatively, medial and lateral covers 136 may be made from a flexible and transparent plastic or rubber such that ribs 235 of shank plate 126 are visible from within medial and lateral covers 136.

Forefoot region 102 also includes a forefoot outsole 142. Forefoot outsole 142 may be made of highly durable and wear-resistant foam, such as ultra-light EVA foam. Forefoot outsole 142 has an upper surface 142*a* and a lower surface 142*b*. Upper surface 142*a* includes a plurality of concaved channels 144. Channels 144 additionally define a portion of bores 140 extending from the lateral side 216 to the medial side 218 of forefoot 102. Forefoot outsole 142 includes a recess 147 formed in a central portion of the forefoot region 102 and a tread pattern 145 along lateral and medial sides 216/218 of recess 147. A tread insert 146 preferably made of natural or synthetic durable rubber is provided in recess 147 to improve the traction of forefoot outsole 142. One skilled in the art can appreciate that recess 147 and tread insert 146 may have a variety of shapes and sizes. Further, more than one recess 147 having tread inserts 146 may be provided in forefoot outsole 142 in a variety of patterns.

Heel region 104 includes a lateral heel piece 148 and a medial heel piece 149. At least one of lateral and medial heel pieces 148/149 includes a tubular insert 150. Lateral and medial heel pieces 148/149 are made of a flexible foam or plastic material, which compresses and absorbs shear forces from a wearer's foot during a typical gait cycle. Tubular insert 150 includes one or more trumpet-shaped tubes 150*a* having a larger opening on an exterior surface, for example 148*a*, of lateral and medial heel pieces 148/149. In other words, each trumpet-shaped tube has a generally gradually decreasing outer and inner perimeter as it extends into medial or lateral heel pieces 148/149 away from an exterior surface of medial or lateral heel pieces 148/149. As such, trumpet-shaped tubes 150*a* define gradually narrowing horizontal bores 151 extending from a lateral side 216 towards a medial side 218 and/or from a medial side 218 to a lateral side 216 of heel pieces 148/149. However, unlike forefoot region 102, bores 151 extend only partially through heel region 104 in that separate bores 151 are provided in each of lateral and medial heel pieces 148/149. In an alternative embodiment, tubular insert 150 may be present in only one of lateral or medial heel pieces 148/149, where increased support or posting is desired. For example, to avoid over-pronation, extra support may be desired in only the lateral heel piece 148.

Trumpet shaped tubes 150*a* may be equal in size or shape, or instead, as illustrated in FIGS. 1 and 2, may vary in size. Also trumpet-shaped tubes 150*a* may be generally circular or oval-shaped. In an alternative embodiment, trumpet shaped tubes 150*a* may be other shapes such as triangular, squared, or irregular shaped. Further, the tubes need not be trumpet-shaped. In yet another embodiment, each tube may have the same diameter throughout its length.

Trumpet-shaped tubes 150*a* may be spaced apart by struts 150*b*, such that tubular insert 150 is formed as a single unit. As such, tubular insert 150 may be injection molded from a plastic resin. Tubular insert 150 may vary in hardness and flexibility, to provide fine tuning of cushioning provided by lateral and medial heel pieces 148/149. Preferably, medial and lateral heel pieces 148/149 are molded around tubular insert 150, such that at least a portion of trumpet shaped tubes 150*a* form an exterior surface of medial and lateral heel pieces 148/149 and such that tubular inserts 150 define horizontal bores 151.

Tubular insert 150 may also include an extension 150*c* that may include a logo or other indicia. Preferably, medial and lateral heel pieces 148/149 are formed of a transparent plastic material. As such all or most of tubular member 150, including struts 150*b* and extension 150*c*, may be visible within medial and lateral heel pieces 148/149. Alternatively, lateral and medial heel pieces 148/149 are molded such that extension 150*c* forms part of an exterior surface of lateral and medial heel pieces 148/149.

In an alternative embodiment, each trumpet-shaped tube 150*a* may be formed separately and individually inserted into lateral and medial heel pieces 148/149. In this case, medial and lateral heel pieces 148/149 may be molded around the individual trumpet-shaped tubes 150*a* or the trumpet-shaped tubes 150*a* may be inserted within lateral and medial heel pieces after they have been molded into shape. As illustrated in FIGS. 1 and 2, lateral heel piece 148 has an extended portion 148*c*, which curves around a rear end of heel region 104, such that lateral heel piece 148 and medial heel piece 149 together form a generally U-shaped heel. Lateral and medial heel pieces 148/149 surround the cut-out portion 132 of shank plate 126. In alternative embodiments, lateral and medial heel pieces 148/149 are connected to form a single U-shaped heel piece. Extended portion 148*c* of lateral heel piece 148 provides additional cushioning at the heel, where a first and hard foot strike occurs with each step during a typical gait cycle.

Heel region 104 also includes a U-shaped heel outsole 152. Heel outsole 152 includes a lateral outsole portion 152*a* which is shaped generally according to lateral heel piece 148 and a medial outsole portion 152*b* which is shaped generally according to medial heel piece 149. Lateral and medial outsole portions 152*a*/152*b* are connected by a thinner and more flexible bridge portion 252*c*. The flexibility of bridge portion 252*c* provides for medial and lateral heel pieces 148/149 to compress separately, providing independent suspension on the lateral and medial sides of heel region 104. For increased stability and reduced dual flexibility, the hardness and/or thickness of bridge portion 252*c* may be increased, reducing the ability of the heel pieces 148/149 to flex separately. In yet another embodiment, bridge portion 252*c* may be removed such that lateral and medial outsole portions 152*a*/152*b* are not interconnected.

Figure 3A:
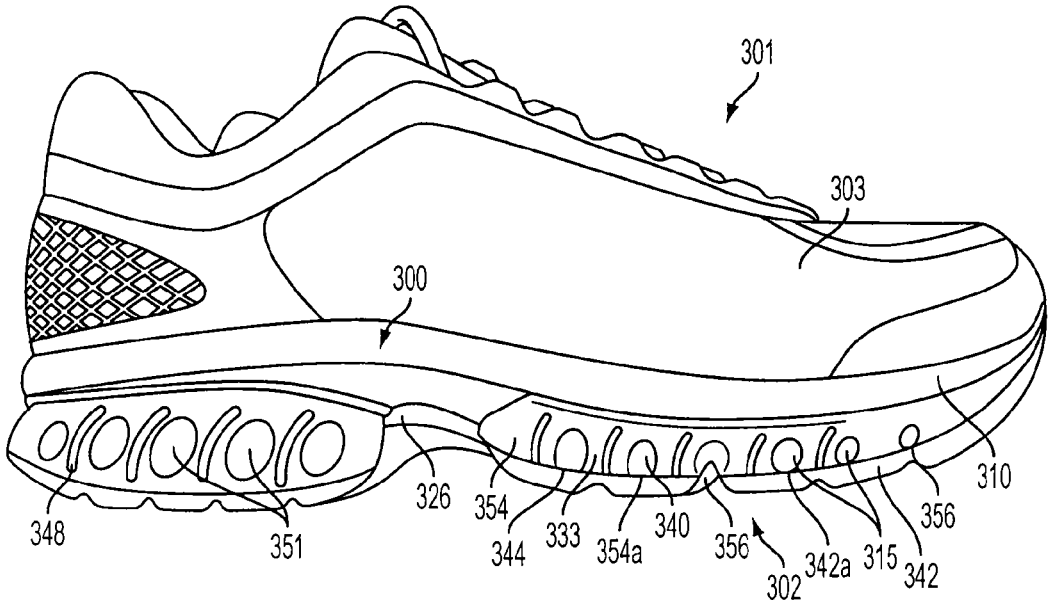
FIG. 3A is a side view of another embodiment of a shoe of the present invention.
Figure 3B:
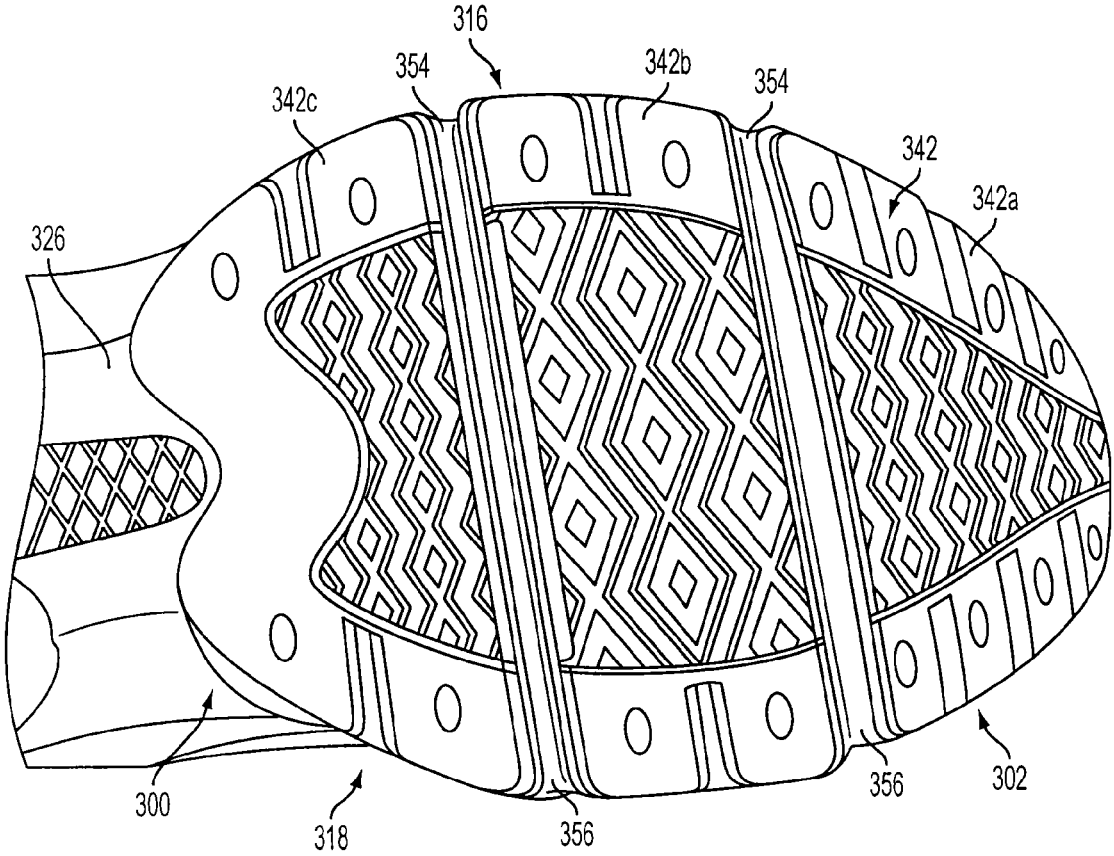
FIG. 3B is a bottom view of the forefoot of the shoe of FIG. 3A.

FIGS. 3A and 3B illustrate an alternative arrangement for forefoot region 302. FIG. 3A illustrates a shoe 301 having an upper 303 and a sole 300. FIG. 3B illustrates forefoot region 302 of sole 300. Forefoot region 302 may require less support and more flexibility due to the need for the forefoot region 302 to flex during walking or running. As such, shank plate 326 has only one rib 333, and shank plate 326 does not extend substantially into forefoot region 302. Forefoot region 302 instead includes a support layer 354 extending from a lateral side 316 to a medial side 318 of sole 300 in forefoot region 302. In this embodiment foot support 310 need not have a lower surface having a plurality of concaved channels, such as channels 215 of FIG. 2. Instead, a lower surface 354*a* of support layer 354 defines a plurality of concaved channels 315 extending across forefoot region 302. Support layer 354 also includes at least one indented ridge 356, where material has been removed from a lower surface 354*a* of support layer 354. Since support layer 354 is thinner where indented ridges 356 are provided, the support layer 354 more easily flexes along the indented ridges 356.

Support layer 354 may be a foam or flexible plastic layer, and may be the same or different material than that of foot support 310. In fact, support layer 354 may be an extension of foot support 310, and may be molded simultaneously therewith. Alternatively, support layer 354 may be a supplemental component coupled to lower surface (not shown) of foot support 310 during manufacturing of shoe 301.

Forefoot region 302 of sole 300 further includes a forefoot outsole 342, which is coupled to lower surface 354*a* of support layer 354 between indented ridges 356. Forefoot outsole 342 is made of rubber or a durable and wear-resistant foam material. Forefoot outsole 342 has three separate outsole section 342*a*/342*b*/342*c*, although it could have more or less than three as would be apparent to one skilled in the art. Alternatively, forefoot outsole 342 may be formed as a single piece covering forefoot region 302, for example where forefoot outsole 342 may be thinner and more flexible over indented ridges 356 of support layer 354 to allow forefoot region 302 to flex during a typical gait cycle, such as bridge portion 152*c* of heel outsole 152 discussed above. An upper surface 342*a* of outsole 342 includes a channel 344 therein which aligns with concaved channels 315 of support layer 354 to define bores 340 extending from lateral side 316 to medial side 318 of sole 300 of forefoot region 302.

In an alternative embodiment, greater or fewer ribs 333 of shank plate 326 may extend into forefoot region 302 for desired stiffness or flexibility within forefoot region 302. Further, the thickness and/or hardness of shank plate 326 may be varied to provide various degrees of support and flexibility.

FIG. 3A also illustrates a lateral heel piece 348. Lateral heel piece 348 is similar to lateral heel piece 148 in FIGS. 1 and 2, with the exception that heel piece 348 does not include tubular insert 150. Lateral heel piece 348 defines horizontal bores 351 therethrough. Although not illustrated, a similar medial heel piece may be present in sole 300 with or without a tubular insert, such as tubular insert 150 of medial heel piece 149.

Figure 4:
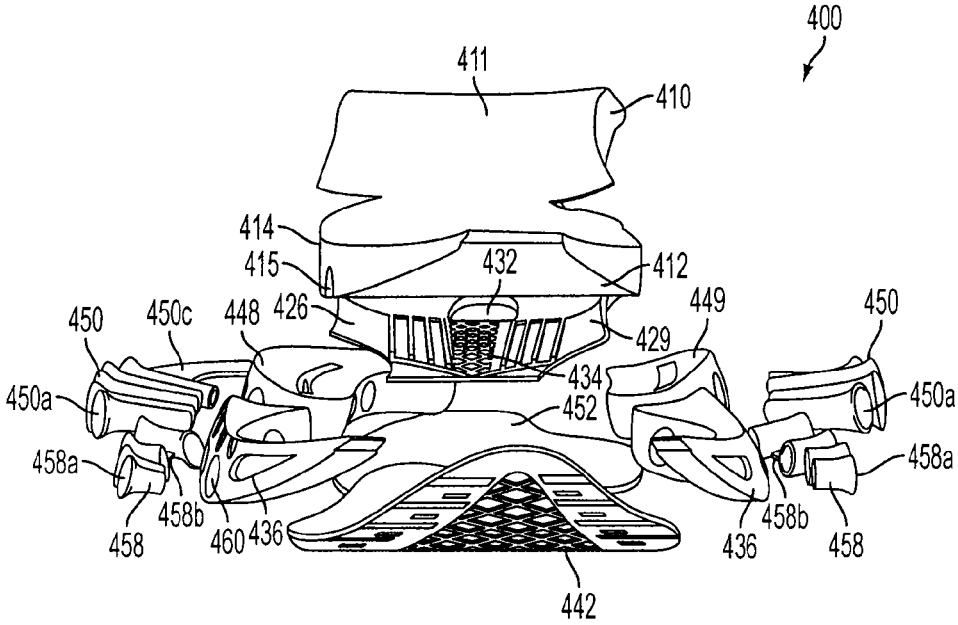
FIG. 4 is a front exploded view of another embodiment of a sole of an article of footwear of the present invention.
Figure 5:
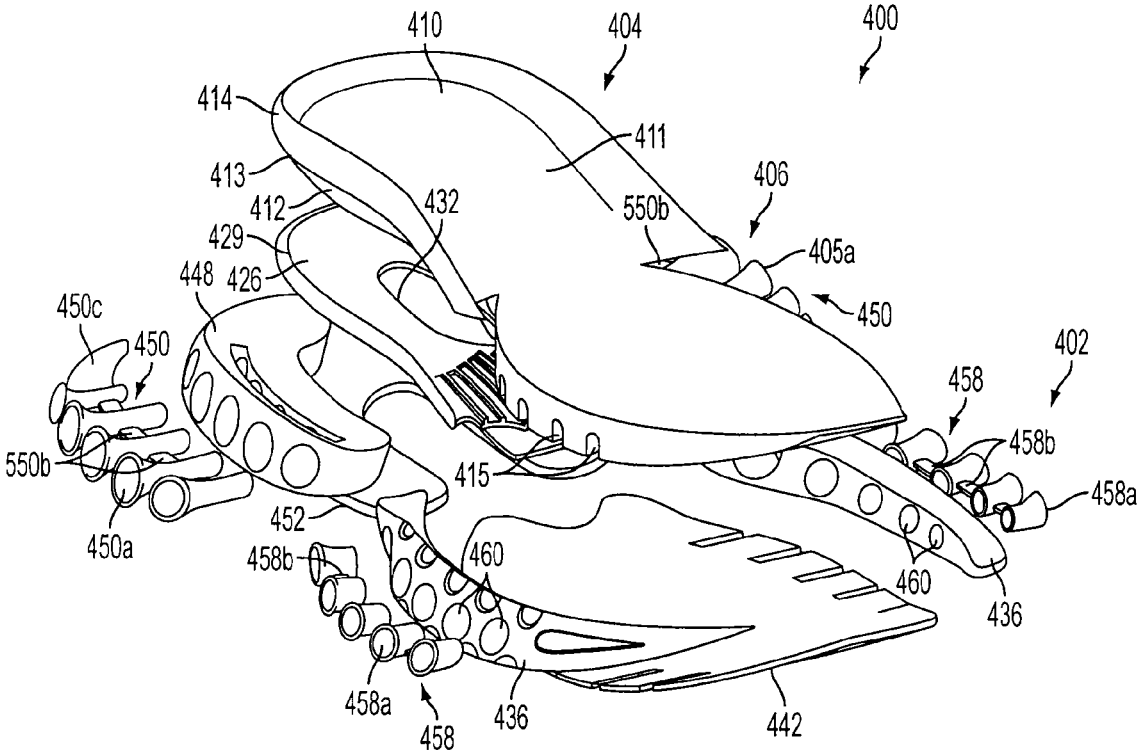
FIG. 5 is a perspective exploded view of the sole of FIG. 4.
Figure 6:
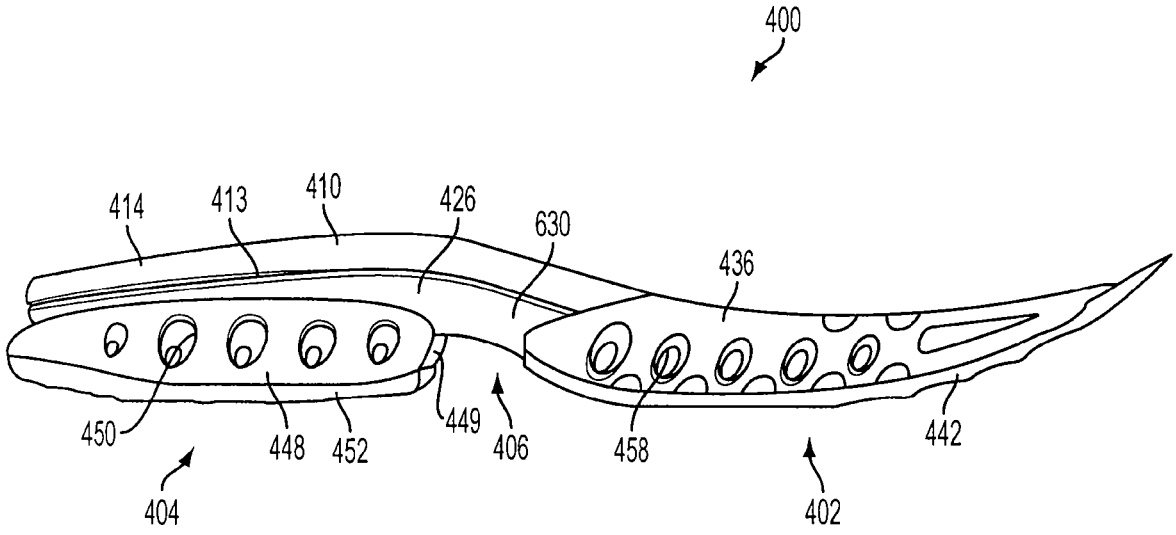
FIG. 6 is a side view of the sole of FIG. 4.

FIGS. 4, 5 and 6 illustrate another embodiment of a sole 400. Sole 400 is similar to sole 100 of FIGS. 1 and 2. For example, sole 400 includes a foot support 410 having an upper surface 411, a lower surface 412 and a side surface 414. Upper surface 411 is illustrated as being concaved to cradle a wearer's foot. Foot support 410 includes a shoulder 413 where lower surface 412 joins side surface 414. Also, lower surface 412 of foot support 410 defines a plurality of concaved channels 415 in a forefoot region 402 of foot support 410. Foot support 410 may also include a protrusion (such as protrusion 731 of FIG. 7) in a heel region 404.

Sole 400 also includes a shank plate 426. Shank plate 426 includes a concaved upper surface 429 and a convexed lower surface 630. Shank plate 426 has a cut-out portion 432 into which the protrusion of foot support 410 is received. Shank plate 426 also includes lattice shape design 434. Unlike shank plate 126 of FIGS. 1 and 2, however, shank plate 426 does not include semi-circular ribs 235 extending into forefoot region 402. Instead, shank plate 426 extends only under heel region 404 and arch region 406.

Similar to that discussed above, heel region 404 includes a lateral heel piece 448 and a medial heel piece 449. Lateral and medial heel pieces 448/449 also include tubular inserts 450. Tubular inserts 450 may include trumpet-shaped tubes 450*a*, struts 550*b* and an extension 450*c*, as discussed in detail above. As best illustrated in FIG. 4, but as equally relevant to medial and lateral heel pieces 148/149 of FIGS. 1 and 2, medial and lateral tubular inserts 450 may be mirror images of each other. Alternatively, the tubular inserts 450 for lateral heel piece 448 may be different than that for medial heel piece 449, for example, extension 450*c* may be removed from the tubular insert 450 for medial heel piece 448 or may have a different curvature or size of trumpet-shaped tubes 450*a*. Lateral and medial pieces 448/449 may be made as discussed above with respect to lateral and medial pieces 148/149.

Heel region 404 also includes a heel outsole 452. Heel outsole 452 may be substantially as discussed above for heel outsole 152 of FIGS. 1 and 2.

Forefoot region 402 of sole 400 includes lateral and medial covers 436. Covers 436 are coupled to side surface 414 of foot support 410 in the forefoot region 402. Covers 436 include tubular inserts 458, similar to tubular inserts 450 in heel pieces 448/449. Tubular inserts 458 include trumpet-shaped tubes 458*a* held together by struts 458*b*. Trumpet-shaped tubes 458*a* may be shorter and diametrically smaller than trumpet-shaped tubes 450*a* found in heel pieces 448/449. Preferably, covers 436 are molded around tubular inserts 458. However, alternatively, tubular inserts 458 may be positioned within holes 460 formed in covers 436. While covers 436 may be made of foam or molded plastic of any color, covers 436 may also be made of transparent plastic such that tubular inserts 458 are visible within covers 436. As with tubular inserts 150 discussed above, trumpet-shaped tubes 458*a* can be any size or shape and need not be oval or tubular-shaped.

Forefoot portion 402 also includes a forefoot outsole 442, which is coupled to covers 436 and a lower surface 412 of foot support 410 in forefoot region 402. Forefoot outsole 442 is made from a durable rubber or a durable and wear-resistant foam material.

Figure 7:
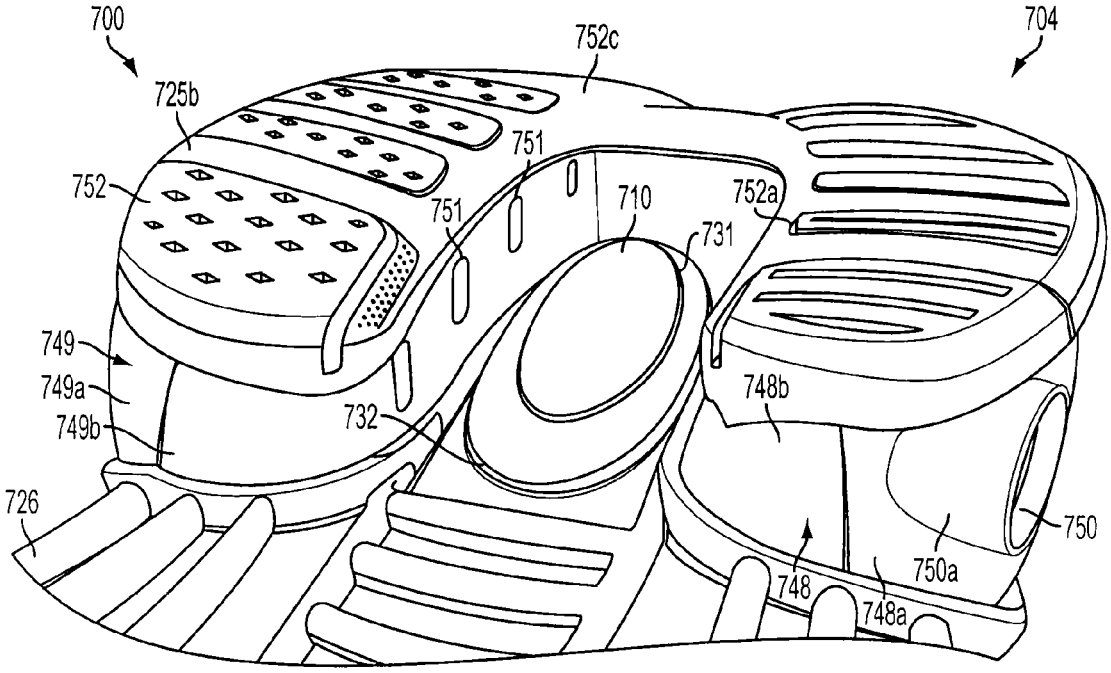
FIG. 7 is a bottom view of a heel region of another embodiment of a sole of the present invention.
Figure 8:
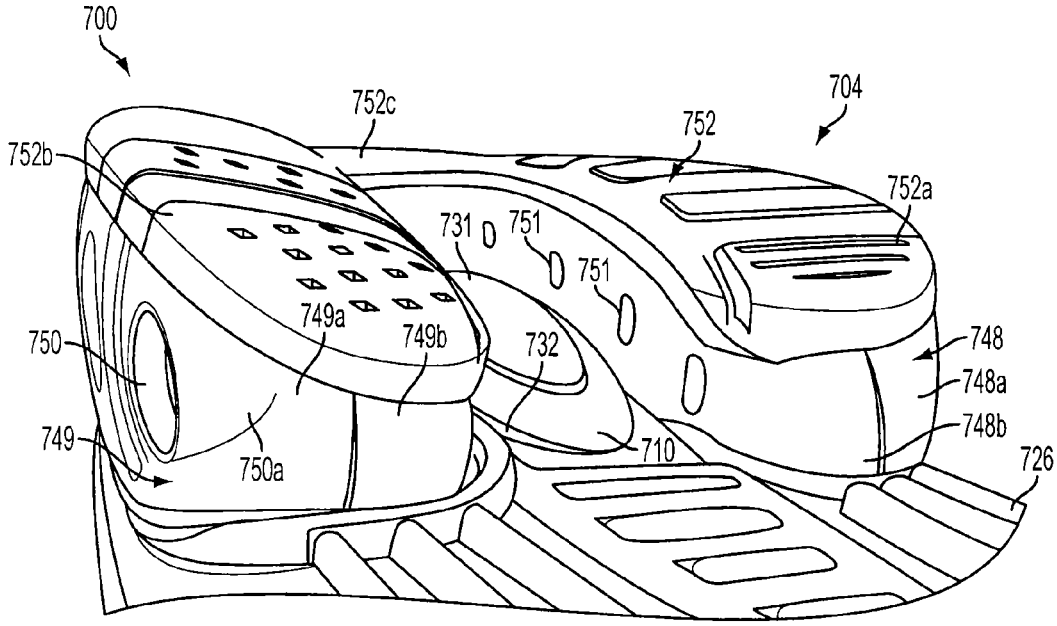
FIG. 8 is a perspective view of the heel region of FIG. 7.
Figure 9:
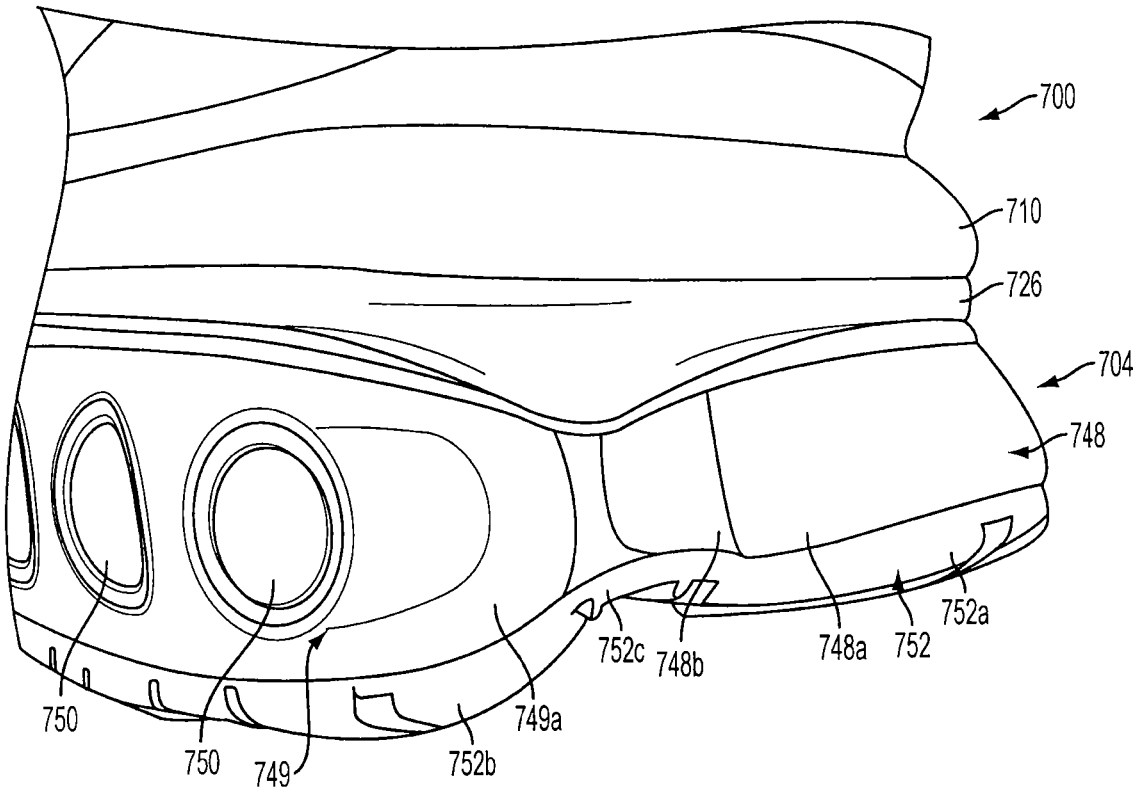
FIG. 9 is a rear view of the heel region of FIG. 7.

FIGS. 7-9 illustrate another embodiment of a heel region 704 of a sole 700 of the present invention. As in the previous embodiments, sole 700 includes a foot support 710 and a shank plate 726. FIGS. 7-9 illustrate how a protrusion 731 of foot support 710 is received by a cut-out portion 732 of shank plate 726.

Heel region 704 also includes a lateral heel piece 748 and medial heel piece 749. Lateral heel piece 748 is divided into an exterior section 748*a* and an interior section 748*b*. Similarly, medial heel piece 749 is also divided into an exterior section 749*a* and an interior section 749*b*.

Exterior sections 748*a*/749*a* are made from a molded flexible plastic and are molded over tubular inserts 750. As discussed above, tubular inserts 750 include trumpet-shaped tubes 750*a* connected together by struts (not shown). Preferably, the exterior sections 748*a*/749*a* are made with transparent plastic material, such that tubular insert 750 are visible within exterior sections 748*a*/749*a*, as illustrated in FIGS. 7-9. The trumpet-shaped tubes 750*a* of tubular inserts 750 are shorter than those previously discussed, since they do not extend entirely through heel pieces 748/749. However, tubular inserts need not be oval or trumpet-shaped as shown, but instead may be other sizes and shapes. Interior sections 748*b*/749*b* are made from a durable foam material, such as EVA foam. Interior sections 748*b*/749*b* include horizontal bores 751 which are aligned with trumpet-shaped tubes 750*a* of tubular insert 750 so as to form bores extending substantially through lateral and medial heel pieces 748/749. The use of foam for interior sections 748*b*/749*b* reduces costs and weight of the shoe as foam is less dense and less expensive than the transparent plastic forming exterior sections 748*a*/749*a*. In alternative embodiments, interior sections 748*b*/749*b* may be reinforced foam to provide additional strength to sole 700.

In an alternative embodiment, tubular insert 750 may be separately molded within both exterior sections 748*a*/749*a* and interior sections 748*b*/749*b* and extend entirely through heel pieces 748/749.

Heel region 704 also includes a heel outsole 752 having a lateral portion 752*a*, a medial portion 752*b* and a bridge portion 752*c*, which is thinner and more flexible than lateral or medial portions 752*a*/752*b*.

Figure 10:
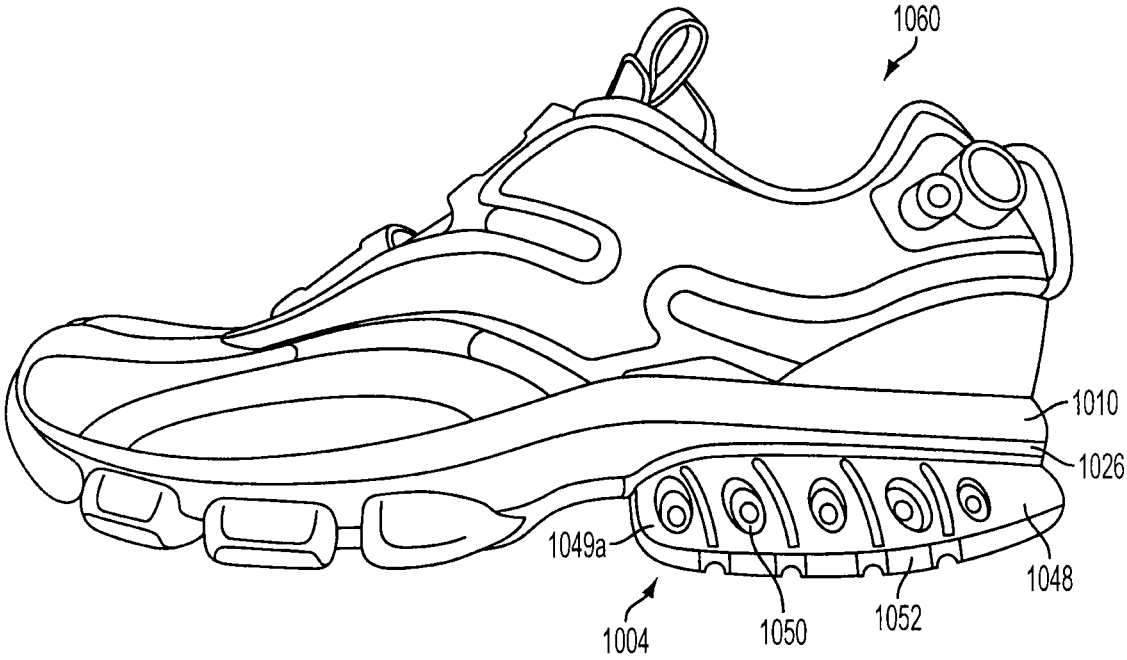
FIG. 10 is a side view of an article of footwear of the present invention incorporating an alternative sole.
Figure 11:
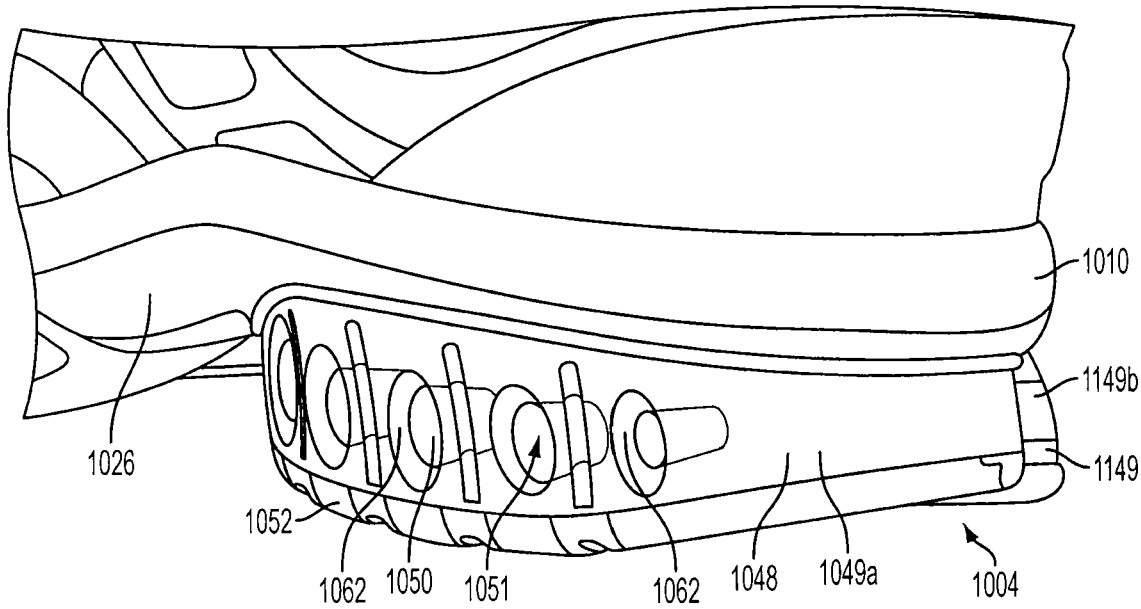
FIG. 11 is a rear perspective view of the sole of FIG. 10.

FIGS. 10-11 illustrate an article of footwear 1060 having a sole 1000 which is similar to sole 700 illustrated in FIGS. 7-9. As best shown in FIG. 11, sole 1000 includes a foot support 1010 and a shank plate 1026. Heel region 1004 also includes a lateral heel piece 1048 and medial heel piece 1149. Lateral heel piece 1048 is divided into an exterior section 1048*a* and an interior section (not shown), as described above with respect to exterior section 748*a* and interior section 748*b*. Similarly, medial heel piece 1149 is also divided into an exterior section 1149*a* and an interior section (not shown), as described above with respect to exterior section 749*a* and interior section 749*b*.

Exterior sections 1148*a*/1149*a* are made from a molded flexible plastic and are molded over tubular inserts 1050. Tubular inserts 1050 are similar to tubular inserts 750 described above, with some significant but slight variations. In particular, tubular inserts 1050 are recess farther into exterior sections 1148*a*/1149*a* than tubular inserts 750 are recessed into exterior sections 748*a*/749*a*. As such, exterior sections 1148*a*/1149*a* forms a significant portion 1062 of the surface defining horizontal bores 1051 extending into lateral heel piece 1048 and medial heel piece 1149.

Heel region 1004 also includes a heel outsole 1052, for example, with a lateral portion, a medial portion and a bridge portion (not shown), which is thinner and more flexible than lateral or medial portions, as described for heel outsole 752.

Figure 12:
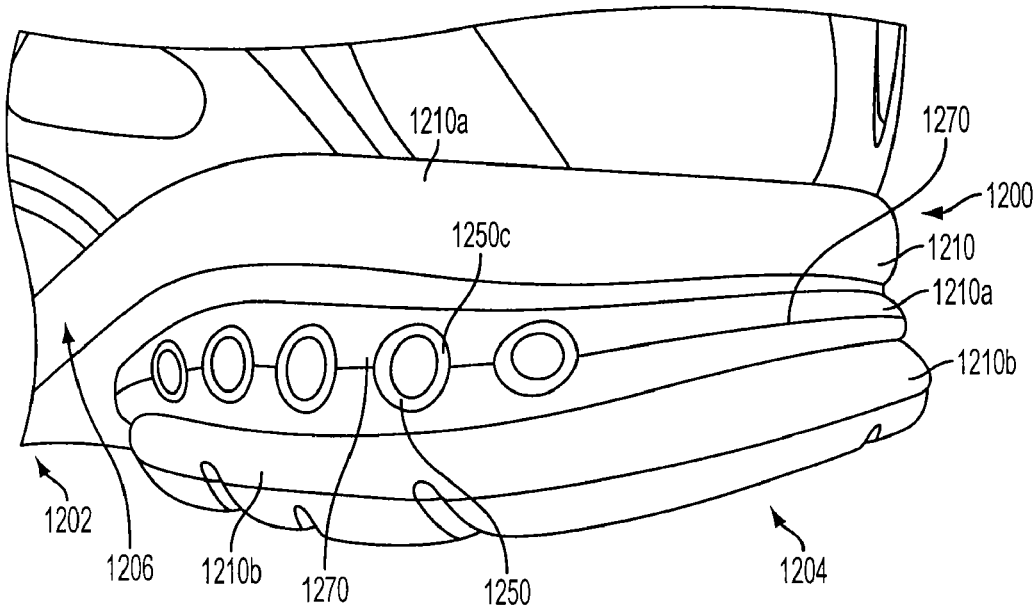
FIG. 12 is a side view of another embodiment of a sole of an article of footwear of the present invention.
Figure 13:
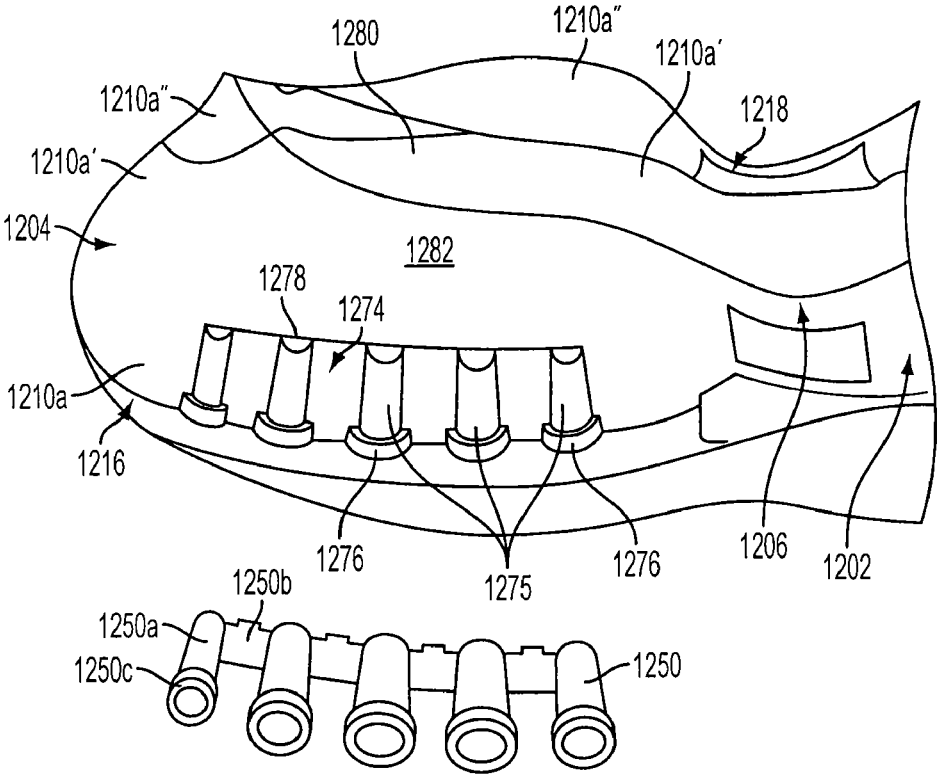
FIG. 13 is an exploded view of components of the sole of FIG. 12.
Figure 14:
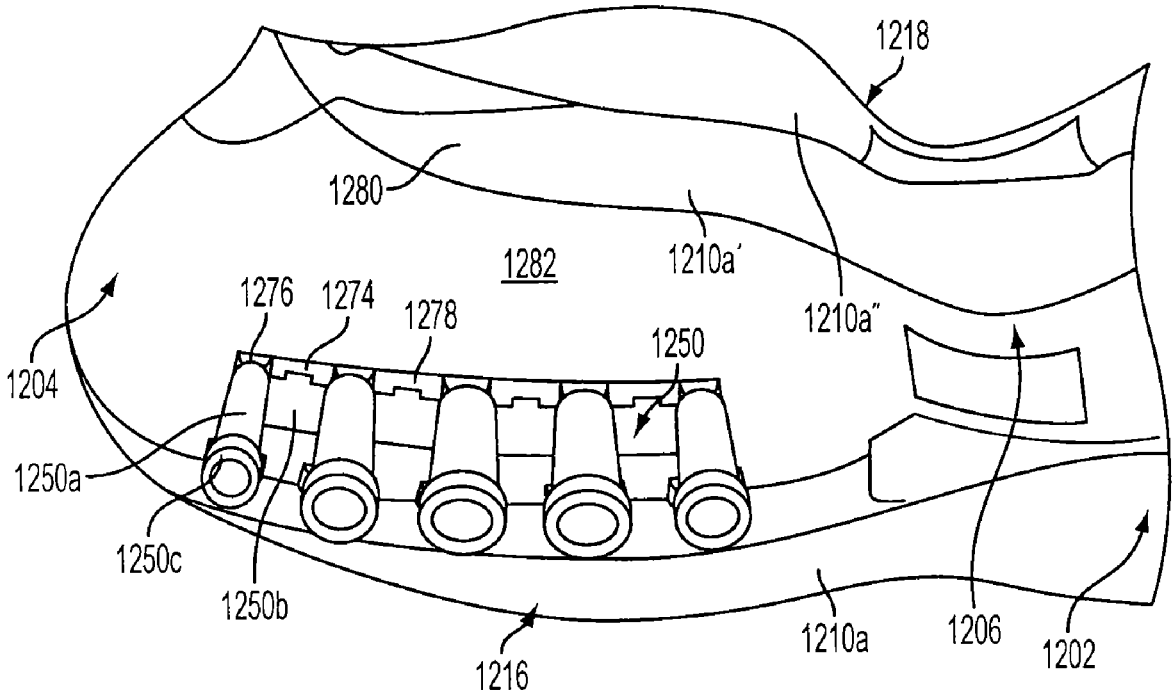
FIG. 14 is a bottom view of the components of FIG. 13 as positioned in the sole of FIG. 12.

FIGS. 12-14 illustrate a sole 1200 including a foot support 1210. Foot support 1210 may be made from conventional midsole materials, such as EVA foam. In a heel region 1204, foot support 1210 is divided into an upper portion 1210*a* and a lower portion 1210*b* which are coupled together along a coupling line 1270. As shown in FIG. 12, upper portion 1210*a* extends into a arch region 1206 and a forefoot region 1202 of sole 1200, while lower portion 1210*b* only forms part of heel region 1204. A tubular insert 1250 is positioned and permanently affixed between upper portion 1210*a* and lower portion 1210*b* of foot support 1210. Heel region 1204 also includes a heel outsole 1252 covering at least a portion of heel region 1204.

As shown in FIGS. 13 and 14, tubular inserts 1250 include trumpet-shaped tubes 1250*a*, which may be of various sizes, held together by struts 1250*b*. With the support provided by foot support 1210, tubular insert 1250 may be made from a less rigid and more flexible thermoplastic resin than, for example, the more rigid tubular inserts 750 and 1050 that are over molded by flexible material in the previous embodiments. Trumpet-shaped tubes 1250*a* include a lip 1250*c* which helps with the placement and visibility of tubular insert 1250. Upper portion 1210*a* and lower portion 1210*b* of foot support 1210 include a first recess 1274. FIG. 14 illustrates how tubular insert 1250 fits within first recess 1274. In particular, first recess 1274 further includes semi-circular shaped second recesses 1275 and deeper third recesses 1276. Each lip 1250*c* aligns with each of deeper third recesses 1276, each trumpet-shaped tube 1250*a* aligns with each semi-circular shaped second recesses 1275 and each strut 1250*b* fits within first recess 1274 between semi-circular second recesses 1275.

Although only upper portion 1210*a* is illustrated in FIGS. 13 and 14, lower portion 1210*b* includes similar shaped recesses (not shown) which are suited to fit the opposite side of tubular insert 1250.

Tubular insert, upper portion 1210*a* and lower portion 1210*b* may be coupled together using any suitable technique apparent to one skilled in the art for attaching portions of shoes together, such as mechanically fastened, glued or otherwise permanently fastened.

As illustrated, tubular insert 1250 does not extend from lateral side 1216 to medial side 1218 of heel region 1204. Rather, it extends only from lateral side 1216 to an intermediate portion 1278 between medial lateral side 1216 and medial side 1218. As such, lower portion 1210*b* may not extend across heel region 1204 from a lateral side to a medial side. For example, upper portion 1210*a* illustrated in FIGS. 13 and 14 shows a wall 1280 defining a medial extent of lower portion 1210*b*. Lower portion 1210*b* fits adjacent wall 1280 within a more lateral area 1282 defined by wall 1280.

Having lower portion 1210*b* separate from upper portion 1210*a* facilitates the placement of tubular insert 1250 during manufacture without having to have tubular insert 1250 injection molded within a heel piece, as in the embodiment discussed above.

The components of the shoe sole embodied above may be made from colored foam, a colored plastic or have an exterior that is painted or otherwise colored. Further, various portions of foot supports disclosed or otherwise described herein may be made of foam having a variety of densities. For example, FIGS. 13 and 14 illustrate upper portion 1210*a* being made from two foam sections 1210*a*' and 1210*a*", which may be molded simultaneously or separately and attached subsequently, having different foam densities. Preferably, more lateral foam section 1210*a*" is more dense than the more lateral foam section 1210*a*'.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An article of footwear, comprising:

a sole defining a heel region, a forefoot region and an arch region that is disposed generally between said heel region and said forefoot region, said sole comprises:

a foot support extending from said heel region to said forefoot region;

a lateral heel piece and a medial heel piece, wherein said lateral and medial heel pieces are discrete and wherein a plurality of horizontal tubes is disposed in at least one of said lateral or medial heel pieces, each of said plurality of horizontal tubes having first and second open ends; and a heel outsole coupled to at least one of said medial or lateral heel pieces.

2. The article of footwear of claim 1, wherein a shank plate, coupled to a lower surface of said foot support, extends from said heel region to said arch region.

3. The article of footwear of claim 2, wherein, in said forefoot region, said shank plate comprises at least one semi-circular rib.

4. The article of footwear of claim 3, wherein said shank plate comprises a plurality of semicircular ribs.

5. The article of footwear of claim 3, wherein said foot support comprises at least one concave channel for receiving said semicircular rib of said shank plate.

6. The article of footwear of claim 3, wherein said semicircular rib defines a portion of a bore within said forefoot region.

7. The article of footwear of claim 1, wherein said tubes have a flared opening at an exterior surface of said at least one of said lateral or medial heel pieces.

8. The article of footwear of claim 1, wherein said one of said lateral or medial heel pieces is molded around said plurality of tubes.

9. The article of footwear of claim 8, wherein at least a portion of one of said medial or lateral heel pieces is made of a transparent material and at least a portion of said plurality of tubes are visible within said one of said medial or lateral heel pieces.

10. The article of footwear of claim 1, wherein said tubes vary in size.

11. The article of footwear of claim 1, wherein said lateral heel piece includes an extended portion in a rear of said heel region, such that said lateral and medial heel pieces form a U-shaped heel.

12. The article of footwear of claim 1, wherein said heel outsole includes a lateral section substantially covering said lateral heel piece, a medial section substantially covering said medial heel piece and a bridge section between said lateral and medial heel section of said heel outsole.

13. The article of footwear of claim 12, wherein said bridge section is thinner than said lateral section or said medial section.

14. The article of footwear of claim 1, wherein said foot support at least partially defines a plurality of horizontal bores in a forefoot region.

15. The article of footwear of claim 14, wherein said forefoot region includes a medial cover and a lateral cover further defining said plurality of horizontal bores.

16. The article of footwear of claim 15, wherein one of said medial or lateral covers further comprises a plurality of tubes.

17. The article of footwear of claim 15, wherein said covers are molded around said plurality of tubes.

18. The article of footwear of claim 1, wherein said one of said medial or lateral heel pieces includes an exterior section and an interior section, wherein said exterior section includes said plurality of tubes.

19. The article of footwear of claim 18, wherein said exterior section is made of a transparent plastic material and said plurality of tubes are visible within said one of said medial or lateral heel piece.

20. The article of footwear of claim 18, wherein said interior section is made from a durable foam.

21. The article of footwear of claim 1, wherein said forefoot region further includes a support layer defining a plurality of channels, wherein said channel defines at least a portion of a plurality of bores extending between a medial and lateral side of said forefoot region.

22. The article of footwear of claim 1, wherein said plurality of tubes are separated by a plurality of struts.

23. An article of footwear, comprising:

a sole defining a heel region, a forefoot region and an arch region that is disposed generally between said heel region and said forefoot region, said sole further comprises:

a foot support including an upper portion extending from said heel region to said forefoot region and a lower portion present only in said heel region of said foot support;

a tubular insert disposed between said upper and lower portions of said foot support, wherein said tubular insert includes a plurality of horizontal tubes having a gradually decreasing perimeter from an exterior surface of said heel region to an intermediate location within said heel region; and a heel outsole coupled to at least said lower portion of said foot support.

24. The article of footwear of claim 23, wherein at least one of said upper portion and said lower portion includes a recess therein that receives said tubular insert.

25. The article of footwear of claim 23, wherein said tubular insert is disposed only in a lateral area of said heel region.

26. The article of footwear of claim 23, wherein said foot support includes a first section and a second section, wherein said first section has a foam density greater than said second section.

27. The article of footwear of claim 26, wherein said first section is disposed in a medial area of said foot support.

* * * * *